US005809721A

United States Patent [19]

Antropius

[11] Patent Number: 5,809,721

[45] Date of Patent: Sep. 22, 1998

[54] COLLABORATING FORMWORK WITH CONNECTED EDGES

[76] Inventor: Jean Daniel Antropius, 24, avenue Jeanne-Léger, F-78150 le Chesnay, France

[21] Appl. No.: 415,625

[22] Filed: Apr. 3, 1995

[30] Foreign Application Priority Data

May 5, 1993 [FR] France ..... 93 05349

[51] Int. Cl.[6] ..... E04B 1/16

[52] U.S. Cl. ..... 52/327; 52/319

[58] Field of Search ..... 52/443, 319, 327

[56] References Cited

U.S. PATENT DOCUMENTS 4,876,837 10/1989 Kelly et al. ..... 52/287.1

FOREIGN PATENT DOCUMENTS 1315913 12/1962 France ..... 52/343
1346013 11/1963 France .
87173 5/1966 France .
1452355 8/1966 France .
2105267 4/1972 France .
2221601 10/1974 France .
2384909 3/1978 France .
1488681 10/1977 United Kingdom .

*Primary Examiner*—Beth Aubrey
*Attorney, Agent, or Firm*—Horst M. Kasper

[57] ABSTRACT

A ribbed metal floor deck for the erection of steel/concrete composite slabs has a cross-section with polygonal ribs. The polygonal ribs exhibit arrises. The ribbed metal floor deck includes non-stripping localized deformations, formed in the arrises of the polygonal ribs. The non-stripping localized deformations have a cross-section of a reentrant shape making the deck non-demolding when embedded in the concrete of the composite slab.

25 Claims, 2 Drawing Sheets

COLLABORATING FORMWORK WITH CONNECTED EDGES

BACKGROUND OF THE INVENTION

1. Field of the Invention

The present invention relates to a ribbed metal sheeting and, more especially, such a sheeting used as formwork for the erection of steel/concrete composite slabs.

2. Description of the Prior Art

Profiled steel sheetings for use as concrete-floor formwork are known. These metal sheetings thus profiled, or in other words ribbed, are semi-rigid; they have lengths which make it possible to cover one or more successive spans of slabs and to bear sufficiently on the permanent supports existing at the ends. They stay in place on the soffit of the slabs after removing the possible shores.

Two types of floor deck made of ribbed metal sheetings may be distinguished: non-composite stay-in-place floor decks, which do not contribute to the working strength of the floor, and composite floor decks which fulfil a reinforcement role for the slabs and which therefore withstand the forces when stresses in a section of the floor tend to cause relative slip between the concrete and the floor deck.

Composite decks form the subject of "Technical Assessments" published in France by CSTB [Scientific and Technical Center for the Building Industry]. These Technical Assessments fix the allowable shear board working stresses, the steel decks having a higher performance rating the higher the shear board working stress.

It is known that non-composite floor decks have only straight ribs in their length direction, these being arranged in such a way that stripping from the concrete would be possible without deformation of said steel decks. With such non-composite floor decks, the slip is not counteracted, the shear bond capacity is zero and there is no contribution from the floor deck to the working strength of the floor.

In contrast, it is known that composite decks must not be able to be stripped. Today, various types of composite decks are known: smooth reentrant composite decks, reentrant composite decks with embossments and open composite decks with embossments.

In smooth reentrant composite decks, the generatrices or ribs are straight, but these ribs are arranged so as to form dovetails which prevent stripping. To be sure, stripping is impossible, but there is no obstacle preventing the concrete from slipping with respect to the form in the longitudinal direction of the deck. Such smooth composite decks therefore have a low performance rating.

In reentrant composite decks with embossments, there are ribs forming dovetails or webs with negative relief (the webs being the regions of the sheeting which are generally oblique with respect to the mid-plane of the sheeting and which connect the flanges, that is to say the parts which are generally parallel to the mid-plane of the sheeting), but, in addition, embossments made in the webs and/or the flanges increase the frictional forces between concrete and form, counteracting the slip and reinforcing the composite action between concrete and steel deck. When the floor is subjected to bending, the embossments of the deck are initiated to operate; they resist concrete/formwork slip and, as a result from releasing from the concrete, deform the directrix (the directrix is the geometrical line of the cross-section of the sheeting floor deck).

Yet another kind of composite deck exists, that called open composite deck with embossments. In that latter kind of form, the generatrices are similar to those of non-composite stay-in-place forms, but their webs have embossments.

As soon as concrete/floor deck relative slip appears, the embossments constitute obstacles which resist this, inducing, as previously, deformations of the directrix.

As seen previously, the using of embossments in the webs and/or flanges of the floor decks determines the efficiency of said floor decks. However, this efficiency still remains insufficient, this limiting in particular the span of the slabs. It is found, in fact, that when these embossments of the webs and/or of the flanges are working, said webs and/or flanges react by bulging, being deformed by intrinsic flexural deformability until the release of the embossments, and these deformations of the webs and/or flanges thus cause the arrises of the sheeting to move closer together, thereby promoting detachment of the metal sheet of the floor deck with respect to the concrete mass. The regions (webs or flanges) having the embossments develop little strength against bending and deformation withstand since these regions are connected to the arrises of the sheeting by plane, and therefore flexible, strips. Furthermore, the embossing techniques used for producing the embossments elongate the metal in all directions in the metal sheet and therefore weaken it, this not being favorable for greater solidity.

Being made on plane parts of the metal sheet under situations which do not permit the use of a blank-press, the embossing can, despite everything, involve only limited depths which do not permit a marked stop effect.

The withstand of the webs to bulging decreases very rapidly when the depth of the web increases, whereas there is an advantage in large web heights when it is desired, as currently required, to have spans well further than 4 meters without shoring. Thus, the solution of large web heights reduces the efficiency of the embossments made in said slabs.

Therefore it is found that current floor decks are ineffective and limiting, and they are incapable of meeting the growing current demand for allowing large-span slabs.

SUMMARY OF THE INVENTION

The present invention aims to provide composite metal decks capable of meeting the current demand and which therefore have a higher performance rating than current floor decks, in particular by resisting metal-sheet/concrete slip better.

The present invention provides for this a ribbed metal floor deck for the erection of steel/concrete composite decks involving the contribution of other modes of deformation of the section of the steel deck which are capable of developing greater resistance even for smaller amounts of slip.

The ribbed metal deck according to the invention, having a cross-section with polygonal ribs furthermore possesses localized reentrant deformations in the fillets of arrises of the ribs. By reentrant is meant a deformation obtained by embossing the metal in such a way that this deformed zone is non-stripping.

Preferably, these localized deformations are made simultaneously on two opposite arrises of the sheeting, namely two arrises of the same type, that is to say, those which bound the same flange. Preferably too, these deformations on two opposite arrises are staggered.

The profile of the deformations is such that at least the upper flange becomes non-stripping.

According to a variant, the floor deck according to the invention furthermore incudes means which reinforce the stiffening of its flanges and/or of its webs and/or which increase its ability to act compositely with the concrete, these means, taken separately or in combination, belonging to the following group: transverse bulging, transverse or oblique ribbing, embossments, lanced bosses, longitudinal ribbing and web stiffeners.

The deformations according to the invention which have shapes such that the section is non-stripping, are furthermore used for hanging.

The invention also provides an apparatus for the manufacture of the floor decks according to the invention, as well as some particular applications of said floor decks.

BRIEF DESCRIPTION OF THE DRAWINGS

The invention will now be described in more detail with reference to the attached figures which depict:

FIG. 1 a floor deck according to the invention,

DESCRIPTION OF THE PREFERRED EMBODIMENT

The invention relates to a floor deck for the erection of steel/concrete composite slabs but it is understood that the word concrete will be taken below, and in particular, in the claims, in a wide sense, encompassing all the binders capable of being incorporated into the composition of slabs.

Figure 1A:
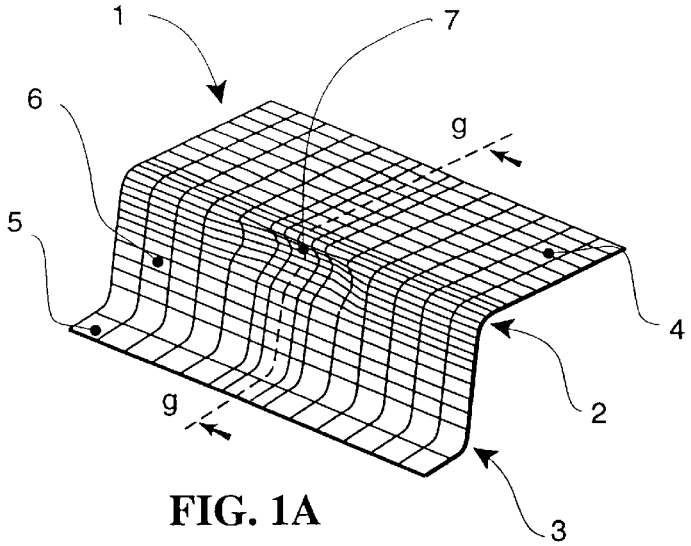
FIG. 1A in a perspective view
Figure 1B:
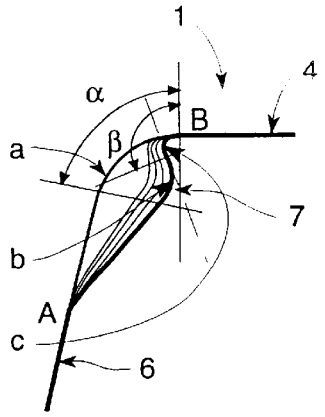
FIG. 1B in a sectional view along the line g—g of FIG. 1A.

FIG. 1 shows a rib portion of a floor deck 1 according to the invention. This floor deck is a sheeting with longitudinal arrises 2, 3 which bound between them areas called flanges, such as 4, 5, when they are parallel to the bearing plane of the slabs and are called webs, such as 6, when they are vertical or oblique and connect the flanges. According to the invention, this sheeting is provided with localized deformations, such as 7, which are produced in the arrises 2, 3 and have a reentrant profile as it is more particularly visible in FIG. 1B. During the operation of embossing the metal of the sheeting in order to produce these reentrant deformations, such as 7, the fillet "a", subtending an angle "α", arising from the profiling is depressed until forming a reverse curvature "b" in the reentrant angle of the section in order to constitute the peak of the deformation 7. At the location of the deformation 7, a new arris "c" is formed, set back with respect to its initial position, and it subtends an angle "β" which advantageously becomes greater than 90°. When the angle "β" is greater than 90° the result is that the new arris "c" is less set back with respect to its initial position than the peak "b" of the deformation 7, thereby rendering any stripping from the concrete impossible. In fact, the distance which separates the two lines joining up, on either side of a flange 4, the peaks "b" of successive deformations 7 along each arris 2 is less than the distance separating the lines joining the bottoms of the new arrises "c": the material housed between the arrises "c" does not make use, between the peaks "b", of the passage necessary for stripping. The facet of metal sheet located between the arrises "c" and the peaks "b" goes back in under the flange between the arrises "c"; it may be said that its relief is negative.

The depth of the deformation 7 is greater at the center than on its edges.

The length "AB" of the arcs and segments constituting the final arris, at the location of the deformation 7, may be unchanged with respect to its initial value, thus leading to no elongation and therefore no thinning nor any fracture of the metal.

However, greater embossing, consequently producing a slight thinning of the metal, is also possible as a variant.

All the geometrical data mentioned hereinabove are particularly illustrated in FIG. 1B.

Figure 2:
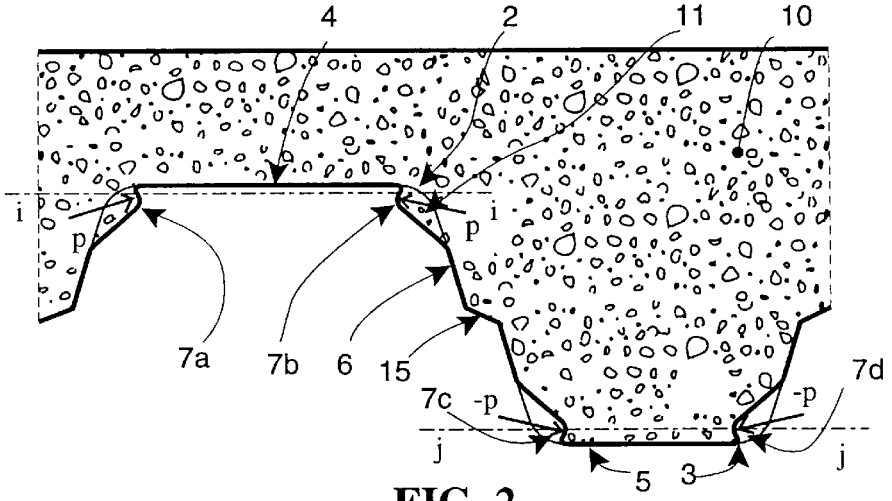
FIG. 2 a section through a slab combined with a floor deck according to the invention.
Figure 3:
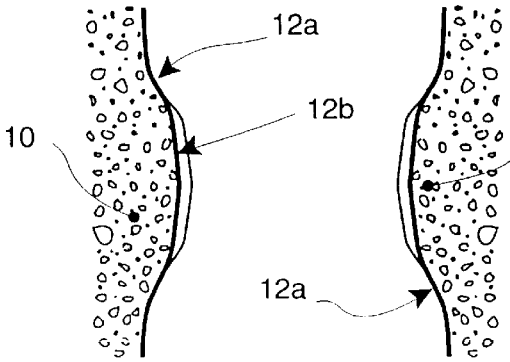
FIG. 3 a section through the slab along the line i—i of FIG. 2.
Figure 4:
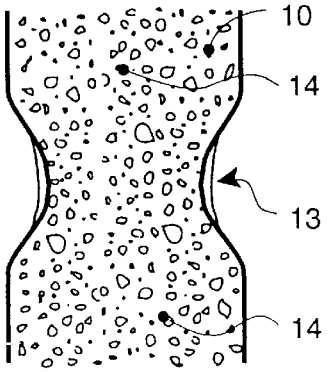
FIG. 4 a section through the slab along the line j—j of FIG. 2.

FIGS. 2, 3 and 4 show the sheeting 1 according to the invention, combined with a slab made of concrete 10. Encountered again in the sectional view in FIG. 2 are the flanges 4 and 5, these being a top flange 4 and a bottom flange 5, webs such as 6, and localized deformations 7*i*, two deformations 7*a* and 7*b* on the top arrises 2 and two deformations 7*c* and 7*d* on the bottom arrises 3.

The concrete 10 envelops the top flanges, such as 4, and the longitudinal arrises, such as 2, which border them. Each deformation, such as 7, in the top arrises, such as 2, is filled by a concrete protuberance 11 which constitutes a stop producing an oblique counteraction directed along the arrow "p" in the case of stressing the slab. The deformations 7 of the top arrises 2 then produce two types of mechanisms which appear more clearly in FIGS. 3 and 4, which are, respectively, sections through a top flange 4 in the region of two deformations 7 and through a bottom flange 5 in the region of two peaks of deformations 7.

Encountered again in FIG. 3 are the protuberances 11 of the concrete 10 which are non-strippable, flanked by narrowings 12*a* of the concrete and connected to the concrete vault above the flange 4 by the necks 12*b* of the channel molded around the depressed arrises "c". Because of this series of protuberances 11 and narrowings 12*a* along the top arrises 2, the sheeting 1 cannot slide with respect to the concrete without involving two mechanisms each causing the metal sheet to be subjected to transverse compression when the slab experiences working stresses which can lead to sliding. According to one of the mechanisms, the wide flange parts of the sheeting 1, which are located between the deformations 7, should be engaged in the narrowings 12*a* of the concrete and the flange parts located facing the deformations 7 should move into the neck 12*b*. Since separation of the top flange 4 from the concrete vault is prevented by the non-stripping shape of the deformation 7, a lateral confinement of the metal sheet of the sheeting 1 is necessary in order to contemplate slip. Such a narrowing could result only from the buckling of the flanges by lateral compression of the metal sheet under the effect of the pressures oriented along the arrow "p", exerted by the protuberances 11, or from the local yielding of the metal butting against the concrete of the narrowings 12*a* and in the necks 12*b*. According to the other associated mechanism, affecting regions of arrises further away from the deformations 7, slipping of the sheeting with respect to the concrete would tend to propagate a fold in the metal sheet in the nondeformed parts of the arrises of the sheeting 1, until producing a groove for passage of the protuberances 11. This second mechanism presses the metal sheet of the arrises 2 against the concrete walls molded by the webs 6 which, reacting by pressures and frictional forces, prevent the fillets of the arris 2 from opening, generating transverse compressions in the flanges 4.

Let us now look at the operation of the bottom-arris system, in relation to FIG. 4. The concrete 10 occupies the internal volume of the reentrant angles of the arrises, with narrowed portions, such as 13, flanked by wider portions, such as 14, this assembly acting as a lock at the location of the deformations 7. In order for slip to be able to occur, it would be necessary for the reentrant deformations 7 of the sheeting 1 to be pushed back, but all these forces exerted by the concrete in the region of the deformations 7 would have to be cumulative in order to reach the transverse tensile yield stress of the metal sheet facing the deformations 7, this yield stress being conjugate with localized crushing of the projecting arrises of the concrete.

Regions of the metal sheet of the top flanges 4 are put into compression and/or regions of the metal sheet of the bottom flanges 5 are put into tension immediately after the initial phase of the slip. The top flange 4 is even already in slight compression arising from the shrinkage of the concrete. Given the high rigidity of the metal in direct compression or in direct tension, the forces developed resist the narrowing of the flanges 4 and/or the widening of the flanges 5, and therefore the effective slip of the sheeting 1 with respect to the concrete 19, as long as extended regions of metal sheet have not reached their elastic limit, this not occurring below a critical intensity of the shear force between the concrete and the floor deck. As a result, the possibilities of slip are then reduced. It may further be stated that there exists a high degree of composite action likened to a connection between slab and floor deck, or else that this composite floor decks is one with connected arrises.

Insofar as the deformations 7 are along a top and/or a bottom arris of the sheeting 1, the slip resistance is greatly enhanced if deformations are also made in the facing arris bounding the top and/or bottom flange on another side. This is shown in FIG. 2.

Preferably, the deformations 7 on an arris are staggered with the deformations 7 of the facing arris on the other side of the flange in order to distribute the contribution of the deformations 7 along the floor deck, the forces then balancing out via oblique paths.

It is possible to have sheetings with only deformations 7 in the top part of the sheetings, or only in the bottom part. However, the forces to be overcome will be even greater, and therefore the sheeting/concrete composite action even better, if the deformations 7 are both in the top part and in the bottom part.

Increasing the number of deformations 7 on the same sheeting 1, and therefore reducing their spacing, increases the composite action of the sheeting with the slab.

As already described in relation to FIGS. 1 and 2, the shapes of the deformations 7 are such that the floor decks are non-strippable, this being obtained in the region of said deformations 7 by a new arris, referenced "c" in FIG. 1B, less set back with respect to the initial profile than the peak of the deformation. This can also be expressed by an angle "β" greater than 90° as already mentioned.

The deformations 7 made in the arrises have depths which progressively increase from their edges until reaching their middle in order to create a wedge effect in the neck 12*b* which involves a consequent length of concrete and of metal butting against each other so as to bring into play the lateral compressive strength of the entire progressively deformed length.

The deformations 7 made according to the invention do not involve, or only slightly, the nominal elongation of the mean fibre of the metal; the thickness of the metal sheet is maintained and the shape variations of the sheeting are progressive, this preventing deterioration of the mechanical performance of the sheeting often observed, already even in the concrete-pouring phase.

Since the deformations according to the invention are made in the arris regions which are more rigid than the webs or the flanges, on the one hand the effectiveness of the connection of the sheeting is not compromised by the malleability, flexibility or intrinsic flexural deformability of said flanges or webs and, on the other hand, they allow production of complementary embossments or of complementary means generally in said flanges or webs promoting composite interaction of the rib deck with the concrete and/or increasing the strength of the floor deck.

Among these complementary means, which may advantageously act together with the deformations 7 according to the invention, let us mention the bulging of the top flanges as a continuous or stepped vault, embossments in the flanges and/or webs, lanced bosses which constitute as many point-like bonds between the rib deck and the concrete, and longitudinal, transverse or oblique web stiffeners or flange stiffeners.

Such longitudinal stiffeners made in the webs, referenced 15 and illustrated in FIG. 2, enable the strength of the floor deck in the casting phase to be substantially increased, especially for deep rib decks.

Advantageously, these deformations 7 may be exploited by serving as hanging bases since they have a so-called "non-strippable" shape, as explained previously.

Figure 5:
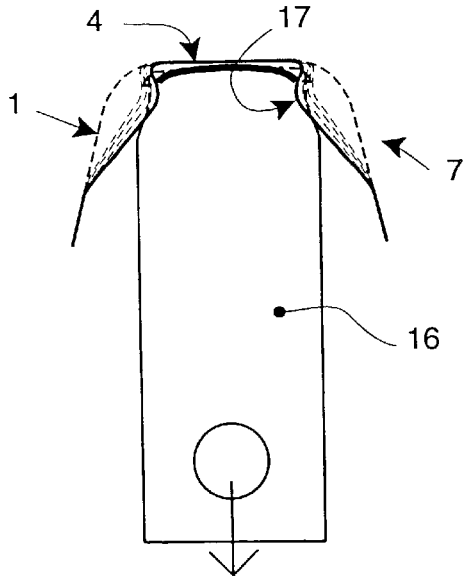
FIG. 5 one mode of hanging the floor deck according to the invention.
Figure 6:
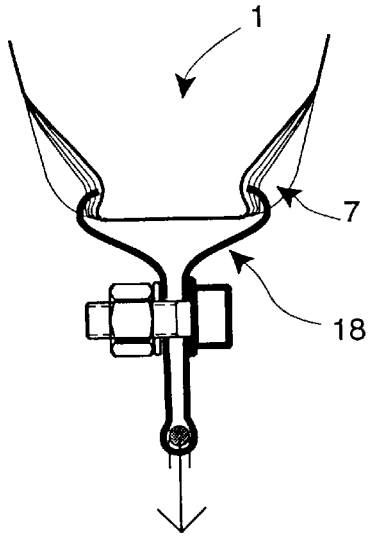
FIG. 6 a other mode of hanging the floor deck according to the invention.

Two modes of hanging are thus illustrated in FIGS. 5 and 6.

The systems are of the type comprising a plate 16 (FIG. 5) engaged in the sheeting, pushed against the top flange 4 and locked in by the peak 17 of the deformation 7, or of the type comprising a clamp 18 (FIG. 6) in order to be fastened to the deformations at the bottom part, being locked in the bottoms of the deformations 7.

The invention thus creates means for locking non-through fixing devices for ceilings, technical equipment, distribution of fluids, or even simply for fixing the floor deck before pouring the concrete or for anchoring the shoring means.

Figure 7:
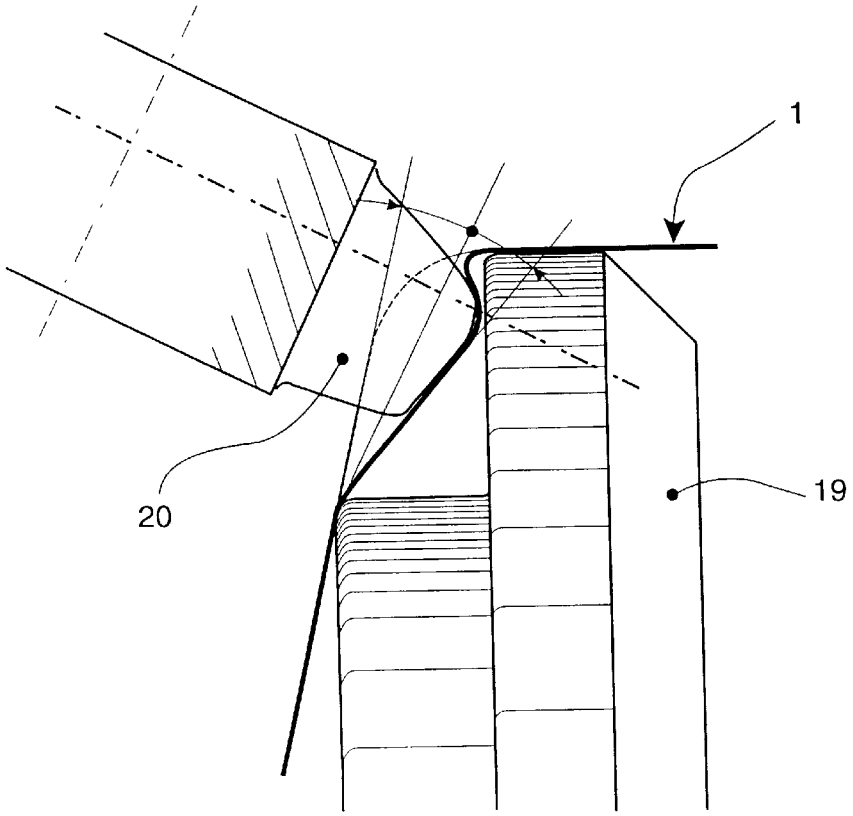
FIG. 7 a toothed-wheel tooth of a machine producing the deformations according to the invention on a ribbed floor deck.

The deformations according to the invention are produced after forming the arrises of the main ribs in the metal sheet of the sheeting 1 using a machine with a modified profiling cage equipped with a conventional shaft, not depicted, this shaft carrying smooth wheels 19 (FIG. 7) to be placed on one side of the sheeting 1 and a series of wheels with teeth 20 on the other side, the axes of which are inclined with respect to the mid-plane of the sheeting circulating in the cage.

Each smooth wheel 19 bears on the metal sheet 1 along two contact lines located on the inside of a reentrant angle of the sheeting on either side of the arris in the vicinity of which the deformations 7 are to be produced. A cut-out shoulder enables the deformations to be formed under the effect of the teeth 20 of the associated toothed wheel.

A toothed wheel in conjunction with a smooth wheel produces the successive deformations on an arris of the sheeting.

The pitch of the teeth 20 on the wheel determines the spacing of the deformations to be produced.

The developed length of a tooth determines the length of the peak of the deformation to be produced.

Sufficient metal has been removed from between the teeth of the toothed wheel in order to avoid contact between the toothed wheel and the sheeting arris coming from the profiling.

The diametral plane of a toothed wheel is substantially perpendicular to the bisector plane of the mean angle formed, on the one hand, by the web of the sheeting in the vicinity of the arris before the deformation is formed and, on the other hand, by that facet of the deformation providing the transition between the peak of the deformation and the preserved central zone of the web.

During the rotation of the toothed wheel on its spindle, the active tooth 20 comes into contact with the metal sheet 1 and depresses the metal inwards through the reentrant angle of the arris between the points of contact of the metal sheet with the angle fillets of the smooth wheel 19.

The arris fillet of the metal sheet rolls around a moving center. The fillet is raised, in order to enable the metal sheet in contact with the tooth 20 to stand up, and then is bent back, returned by the metal sheet 1 which draws a contour in the form of a hairpin bend.

Certain fibers of the metal sheet are stretched longitudinally by the action of the teeth 20.

The plastic deformation of these metal parts is not likely to cause buckling of the metal sheet in the section portions beyond the points of contact with the smooth wheel. The tensile stresses created when forming the deformation 7 reach the elastic limit of the metal. They are balanced by compressive stresses created in the neighboring regions of the arris beyond the points of contact with the smooth wheel which provide greatly superior areas of metal. These regions remain stiffened by the arris and held by the smooth wheel.

The critical stresses for buckling of the metal sheet, which are close to the elastic limit of the metal, are not reached as long as a ratio of less than one is respected between the stretches of metal involved in the simultaneous production of the deformations and the stretches of metal which are available between these regions on the same cross-section of the sheeting, on the same line of smooth wheels 19.

The invention relates to new sheetings with deformations 7 but it also relates to sheetings with deformations 7 obtained from sheetings initially intended for current open or reentrant composite decks or non-composite decks, and then modified in order to render them into decks with connected arrises according to the invention.

Thus, the manufacture of the sheetings according to the invention may be performed in line or off line.

The sheetings according to the invention may also be usable as means for bonding various panels, especially insulation panels, for example those with an organic foam core.

The invention has described deformations 7 made in the arrises of the sheetings. It is advantageous for the deformations to act on the fillet of the arrises since this makes it possible not, or virtually not, to stretch the metal in order to produce the deformations 7, to mobilize the pressures "p" without introducing a tendency for disbandment of the webs or flanges with respect to the concrete and to transmit the pressures "p" to the flanges directly, while still virtually maintaining the integralness of the width of the flanges for greater flexural strength of the sheeting. However, a slight displacement of the deformation with respect to the arris is still dependent on the invention and thus it is possible to allow, as forming part of the invention, any deformation within the arris fillet affecting it or in continuity with it. Distances from the start of the deformation, with respect to the point of connection of the arris fillet with the web, of the order of 4T (T being the thickness of the metal sheet) may be allowed.

Under these conditions, any deformation which involves, during the operation of the slab, the transverse tensile or compressive strength of the flanges beyond the possible bending of the webs forms part of the invention.

What we claim is:

1. A ribbed metal floor deck for the erection of steel/concrete composite slabs having a cross-section with polygonal ribs, wherein the polygonal ribs exhibit arrises, and wherein non-stripping localized deformations, formed in the arrises of the polygonal ribs, have a cross-section of a reentrant shape making the deck non-demolding when embedded in the concrete of the composite slab.

2. The floor deck according to claim 1, wherein said deformations are simultaneously arranged along two arrises, facing each other, delimit a single flange extending as an elongated flat sheet of metal.

3. The floor deck according to claim 2, wherein the deformations along two facing arrises are staggered.

4. The floor deck according to claim 1, wherein the deformations have depths progressively increasing from edges of the deformations in the arrises toward a center of the deformations.

5. The floor deck according to claim 1, further including at least a member selected of the group consisting of:

a transverse bulge of flanges of the floor deck;

a transverse ribbing and an oblique ribbing;

an embossment;

a lanced boss;

a longitudinal ribbing;

a web stiffener, and combinations thereof.

6. The floor deck according to claim 1, associated with hanging means of the type comprising a fixing means fixed to the deformations.

7. A process for manufacturing a floor deck according to claim 1, using a sheeting and embossing the sheeting without, or virtually without, elongation of the deck sheeting.

8. A machine for the manufacture of a floor deck according to claim 1, including wheels of the toothed-wheel type, each tooth embossing the deck in order to form a deformation.

9. A machine according to claim 8, wherein axes of the wheels are oblique with respect to the mid-plane of the deck.

10. A ribbed metal floor deck for the erection of steel/concrete composite slabs having a cross-section with polygonal ribs, wherein the polygonal ribs exhibit arrises, wherein non-stripping localized deformations, formed in the arrises of the ribs, have a cross-section of a reentrant shape making the deck non-demolding when embedded in the concrete of the composite slab, wherein the localized deformations are bulges protruding in a direction toward the slabs, wherein each of the bulges exhibits a peak, wherein the peak is surrounded by a center area with radii of curvature directed toward the slab, wherein the center area is surrounded by a ring of inclination points, and wherein the ring of inclination points is surrounded by a region with radii of curvature directed away from the slab.

11. The ribbed metal floor deck according to claim 10 wherein the radii of curvatures within the center area and within the region form a continuous surface function.

12. The ribbed metal floor deck according to claim 10 wherein the localized deformations extend in a longitudinal direction of the ribs over a diameter which is less than a repetition width of the ribs.

13. A ribbed metal floor deck for the erection of steel/concrete composite slabs comprising an elongated substantially plain base having a first longitudinal edge and having a second longitudinal edge;

a first side sheet connected to the base along the first longitudinal edge and forming a first obtuse angle and a first reflex angle with the base;

a second side sheet connected to the base along the second longitudinal edge and forming a second obtuse angle and a second reflex angle with the base wherein the second obtuse angle is adjacent to the same side of the plain base as is the first obtuse angle and wherein the second reflex angle is adjacent to the same side of the plain base as is the first reflex angle, and wherein the elongated substantially plain base, the first side sheet and the second side sheet form a channel;

a first bulge disposed in the first side sheet and protruding into a first angle range defined by the first reflex angle, wherein the first bulge extends over a first limited region in longitudinal direction of the plain base for avoiding motion in longitudinal direction when the channel is embedded in a coherent material on the side of the channel defined by the first reflex angle and by the second reflex angle; and wherein a first inclination point exists in a first neighborhood of a first peak of the first bulge, wherein a first tangential plane spanned at the first inclination point forms a first acute angle relative to the base when measured in comparison to the first obtuse angle for avoiding motion of the channel in a direction perpendicular to the base when the channel is embedded in a coherent material on the side of the channel defined by the first reflex angle and by the second reflex angle;

a second bulge disposed in the second side sheet and protruding into a second angle range defined by the second reflex angle, wherein the second bulge extends over a second limited region in longitudinal direction of the plain base for avoiding motion in longitudinal direction when the channel is embedded in a coherent material on the side of the channel defined by the first reflex angle and by the second reflex angle; and wherein a second inclination point exists in a second neighborhood of a second peak of the bulge, wherein a second tangential plane spanned at the second inclination point forms a second acute angle relative to the base when measured in comparison to the second obtuse angle for avoiding motion in a direction perpendicular to the base when the channel is embedded in a coherent material on the side of the channel defined by the first reflex angle and by the second reflex angle.

14. The ribbed metal floor deck according to claim 13, wherein the first bulge is disposed immediately next to the first longitudinal edge; and wherein the second bulge is disposed immediately next to the second longitudinal edge.

15. The ribbed metal floor deck according to claim 13, wherein the first side sheet exhibits a first side edge extending in parallel to the longitudinal direction of the base and on a side of the first side sheet disposed remote relative to the first longitudinal edge;

wherein the second side sheet exhibits a second side edge extending in parallel to the longitudinal direction of the base and on a side of the second side sheet disposed remote relative to the first longitudinal edge;

further comprising a second base formed like the first base and disposed substantially on parallel to the first base and having a longitudinal second base edge connected to the first side edge, and forming a third obtuse angle and a third reflex angle with the second base;

a third bulge disposed in the first side sheet and protruding into a third angle range defined by the third reflex angle, wherein the third bulge extends over a third limited region in longitudinal direction of the second plain base for avoiding motion in longitudinal direction when the channel is embedded in a coherent material on the side of the channel defined by the first reflex angle and by the second reflex angle; and wherein a third inclination point exists in a third neighborhood of a third peak of the third bulge, wherein a third tangential plane spanned at the third inclination point forms a third acute angle relative to the second base when measured in comparison to the third obtuse angle for avoiding motion of the channel in a direction perpendicular to the second base when the channel is embedded in a coherent material on the side of the channel defined by the first reflex angle and by the second reflex angle; and a third base formed like the first base and disposed substantially on parallel to the first base and having a longitudinal third base edge connected to the second side edge, and forming a fourth obtuse angle and a fourth reflex angle with the third base;

a fourth bulge disposed in the second side sheet and protruding into a fourth angle range defined by the fourth reflex angle, wherein the fourth bulge extends over a fourth limited region in longitudinal direction of the third plain base for avoiding motion in longitudinal direction when the channel is embedded in a coherent material on the side of the channel defined by the first reflex angle and by the second reflex angle; and wherein a fourth inclination point exists in a fourth neighborhood of a fourth peak of the fourth bulge, wherein a fourth tangential plane spanned at the fourth inclination point forms a fourth acute angle relative to the third base when measured in comparison to the fourth obtuse angle for avoiding motion of the channel in a direction perpendicular to the third base when the channel is embedded in a coherent material on the side of the channel defined by the first reflex angle and by the second reflex angle.

16. The ribbed metal floor deck according to claim 13 wherein the first bulge and the second bulge are disposed substantially at corresponding longitudinal positions relative to the base and are facing each other.

17. The ribbed metal floor deck according to claim 13 wherein the third bulge and the fourth bulge are disposed substantially at corresponding longitudinal positions relative to the channel and are directed away from each other.

18. The ribbed metal floor deck according to claim 13, wherein the first bulge exhibits a first continuous field of curvatures interrupted by a first ring of inclination points surrounding the first peak of the first bulge; and wherein the second bulge exhibits a second continuous field of curvatures interrupted by a second ring of inclination points surrounding the second peak of the second bulge.

19. The ribbed metal floor deck according to claim 13, wherein a first height of the first bulge as measured relative to a first medium plane at a first floor of the first bulge is less than a diameter of the first floor of the first bulge, and wherein a second height of the second bulge as measured relative to a second medium plane at a second floor of the second bulge is less than a diameter of the second floor of the second bulge.

20. A ribbed metal floor deck for the erection of steel/concrete composite slabs comprising an elongated substantially plain base having a first longitudinal edge and having a second longitudinal edge;

a first side sheet connected to the base along the first longitudinal edge and forming a first obtuse angle and a first reflex angle with the base;

a second side sheet connected to the base along the second longitudinal edge and forming a second obtuse angle and a second reflex angle with the base wherein the second obtuse angle is adjacent to the same side of the plain base as is the first obtuse angle and wherein the second reflex angle is adjacent to the same side of the plain base as is the first reflex angle, and wherein the elongated substantially plain base, the first side sheet and the second side sheet form a channel to be embedded in a slab;

a first bulge disposed in the first side sheet and protruding into a first angle range defined by the first reflex angle, wherein the first bulge includes a first center area with radii of curvature directed toward the slab, wherein the first center area is surrounded by a first ring of inclination points, and where the first ring of inclination points is surrounded by a first region with radii of curvature directed away from the slab;

a second bulge disposed in the second side sheet and protruding into a second angle range defined by the second reflex angle, wherein the second bulge includes a second center area with radii of curvature directed toward the slab, wherein the second center area is surrounded by a second ring of inclination points, and where the second ring of inclination points is surrounded by a second region with radii of curvature directed away from the slab.

21. The ribbed metal floor deck according to claim 1, wherein the localized deformations are shaped in the form of protruding peaks extending substantially laterally and surrounded by recesses.

22. The ribbed metal floor deck according to claim 3, wherein the depths of the deformations progressively increase in a longitudinal direction of the metal floor deck.

23. A ribbed metal floor deck for the erection of steel/concrete composite slabs having a cross-section with polygonal ribs, wherein the polygonal ribs exhibit arrises, wherein reentrant bumps are formed in the arrises of the polygonal ribs, and wherein the bumps are disposed on opposing arrises for furnishing a clamp in the ribbed metal floor deck relative to a concrete cast into the floor deck.

24. The ribbed metal floor deck according to claim 23, wherein angles are formed between sections of the rib and the arrises, the angles being obtuse angles.

25. A ribbed metal floor deck for the erection of steel/concrete composite slabs having a cross-section with polygonal ribs, wherein the ribs have a non-stripping, reentrant localized shape with a peak formed by a center surrounded by a convex face and wherein the convex face is surrounded by a concave ring having an outer periphery joining the ribs.

* * * * *